US006273671B1

(12) United States Patent
Ress, Jr.

(10) Patent No.: US 6,273,671 B1
(45) Date of Patent: Aug. 14, 2001

(54) BLADE CLEARANCE CONTROL FOR TURBOMACHINERY

(75) Inventor: Robert A. Ress, Jr., Carmel, IN (US)

(73) Assignee: Allison Advanced Development Company, Indianapolis, IN (US)

( * ) Notice: Subject to any disclaimer, the term of this patent is extended or adjusted under 35 U.S.C. 154(b) by 0 days.

(21) Appl. No.: 09/563,291

(22) Filed: May 3, 2000

Related U.S. Application Data

(60) Provisional application No. 60/146,457, filed on Jul. 30, 1999.

(51) Int. Cl.[7] ..... F01D 11/16

(52) U.S. Cl. ..... 415/1; 415/14; 415/17; 415/26; 415/47; 415/173.1; 415/173.2; 415/173.3

(58) Field of Search ..... 415/1, 126, 128, 415/173.1, 173.2, 173.3, 14, 17, 26, 47, 48

(56) References Cited

U.S. PATENT DOCUMENTS

| | | | |
|---|---|---|---|
| 4,264,271 | 4/1981 | Libertini | 415/170 A |
| 4,343,592 | 8/1982 | May | 415/171 |
| 4,369,017 | 1/1983 | Carlini | 415/157 |
| 4,487,016 | 12/1984 | Schwarz et al. | 60/204 |
| 4,523,896 | 6/1985 | Lhenry et al. | 417/244 |
| 4,687,412 | 8/1987 | Chamberlain | 415/134 |
| 4,993,917 | 2/1991 | Kulle et al. | 415/105 |
| 5,104,287 | 4/1992 | Ciokajlo | 415/173.2 |
| 5,203,673 | 4/1993 | Evans | 415/173.2 |
| 5,263,816 | 11/1993 | Weimer et al. | 415/131 |
| 5,427,498 | 6/1995 | Lehe et al. | 415/58.2 |
| 5,545,007 * | 8/1996 | Martin | 415/173.2 |
| 5,658,125 | 8/1997 | Burns et al. | 415/1 |
| 5,749,700 | 5/1998 | Henry et al. | 415/104 |
| 5,800,120 | 9/1998 | Ramsay | 415/129 |

FOREIGN PATENT DOCUMENTS

| | | | |
|---|---|---|---|
| 61-152906 * | 7/1986 | (JP) | 415/173.3 |
| 61-152907 * | 7/1986 | (JP) | 415/173.2 |
| 62-142808 * | 6/1987 | (JP) | 415/173.2 |
| 2-223606 * | 9/1990 | (JP) | 415/173.3 |

* cited by examiner

*Primary Examiner*—Christopher Verdier
(74) *Attorney, Agent, or Firm*—Woodard, Emhardt, Naughton, Moriarty & McNett

(57) ABSTRACT

A system includes a gas turbine engine having a shroud and a rotor with one or more blades. The rotor rotates within the shroud to pressurize a fluid during operation of the engine. An electromagnetic actuator is also included that is operable to move the shroud relative to the rotor to adjust clearance between the shroud and blades. In addition, a controller is included in this system to determine a desired amount of clearance in accordance with an operating mode of the engine. The controller generates an actuation signal to change the clearance in correspondence with the desired amount. The electromagnetic actuator responds to the actuation signal to provide the desired amount of clearance.

68 Claims, 5 Drawing Sheets

BLADE CLEARANCE CONTROL FOR TURBOMACHINERY

CROSS-REFERENCE TO RELATED APPLICATIONS

The present application claims the benefit of U.S. Provisional Patent Application No. 60/146,457 filed Jul. 30, 1999, which is hereby incorporated by reference.

BACKGROUND OF THE INVENTION

The present invention relates to turbomachinery, and more specifically, but not exclusively, relates to the control of clearance between an impeller and a shroud of a turbomachine.

It is often desirable to minimize clearance between the blade tips of an impeller rotating within a gas turbine engine and a surrounding blade tip shroud to reduce leakage of a working fluid around the blade tips. Frequently, blade clearance minimization is of particular interest for centrifugal compressor stages. One approach to blade clearance minimization has been to provide an abradable coating on the shroud surface that may be rubbed away by blade contact to create a reduced clearance customized to the particular blade/shroud arrangement. Unfortunately, this type of coating may not be suitable for some gas turbine engine applications—especially those where a smooth shroud surface is desired. Indeed, rough, uneven surfaces commonly associated with abradable coatings often adversely impact engine performance. Moreover, it is sometimes desirable to dynamically change clearance during operation, which is not accommodated by such coatings.

Consequently, several actuation schemes have arisen to provide for blade tip clearance adjustment during engine operation. Unfortunately, these systems often include complicated linkages, contribute significant weight, and/or require a significant amount of power to operate. Thus, there continues to be a demand for advancements in blade clearance technology.

SUMMARY OF THE INVENTION

One form of the present invention is a unique blade clearance arrangement for a turbomachine. In other forms, unique systems and methods of turbomachine blade clearance are provided.

A further form of the present invention includes providing a gas turbine engine including a shroud and an impeller. For this form, the impeller is rotated within the shroud to provide a pressurized fluid to operate the engine. The shroud is moved relative to the impeller by electromagnetic actuation to adjust clearance between the shroud and the impeller. As used herein, "impeller" refers to any device arranged to impart motion to a working fluid when rotated. By way of nonlimiting example, an impeller may be formed as one piece, or from multiple pieces and may include one or more blades, airfoil members, or the like, to direct working fluid during rotation.

In still another form of the present invention, a gas turbine engine includes a shroud and an impeller rotatable within the shroud. An electromagnetic actuator operates to move the shroud relative to the impeller to adjust clearance between the shroud and the impeller. A controller may be included to determine a desired amount of clearance and generate an actuation signal to change the clearance in correspondence with this desired amount.

Yet a further form of the present invention includes operating a turbomachine including a shroud and an impeller, and an electromagnetic actuator to adjust clearance between the shroud and the impeller. This clearance is decreased by increasing electrical power supplied to the actuator and is increased by decreasing the electrical power. The elements may be arranged to maximize clearance between the shroud and impeller during a power loss to the actuator to provide for fail-safe operation.

Further objects, features, forms, embodiments, aspects, advantages, and benefits of the present invention shall become apparent from the description and drawings contained herein.

DESCRIPTION OF THE PREFERRED EMBODIMENTS

Figure 1:
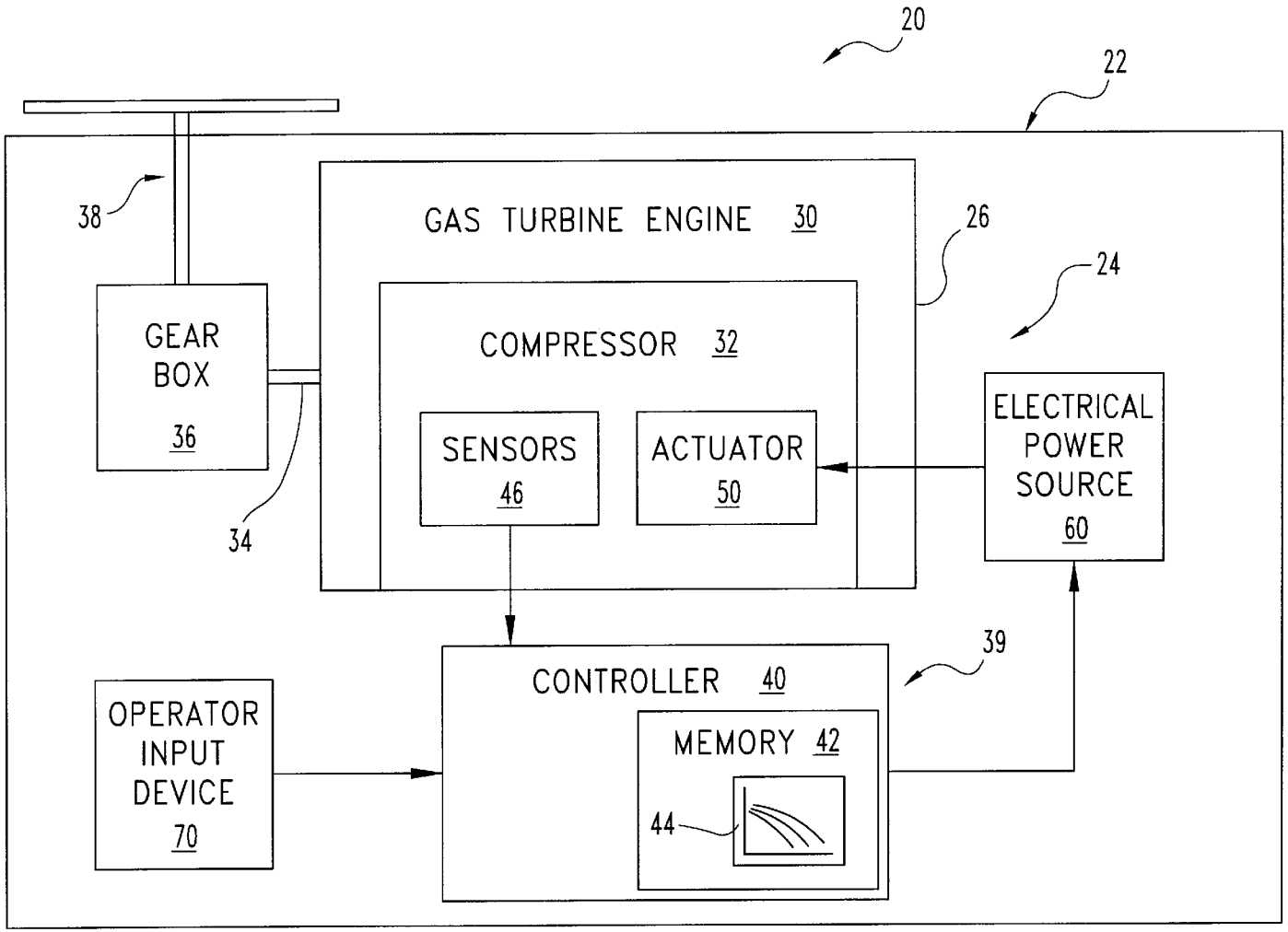
FIG. 1 is a schematic view of a system of one embodiment of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

FIG. 1 shows aircraft system 20 of one embodiment of the present invention. System 20 includes aircraft 22 with power/propulsion system 24. As used herein, aircraft 22 refers broadly to any type of flying device, including but not limited to airplanes, helicopters, missiles, and spacecraft delivery vehicles of either a manned or unmanned variety. Power/propulsion system 24 includes turbomachine 26 in the form of gas turbine engine 30. Gas turbine engine 30 includes compressor 32. Although not shown to preserve clarity, gas turbine engine 30 typically also includes at least one turbine and combuster, a fuel subsystem, and may further include intercoolers, reheat combustion chambers, and/or other devices commonly associated with gas turbine engines as are known to those skilled in the art.

Gas turbine engine 30 is configured to turn shaft 34 to provide mechanical power to gear box 36. In response, gear box 36 turns propulsion device 38 which may be a propeller, helicopter rotor, or other type of propulsion device known to those skilled in the art. In other embodiments, gas turbine engine 30 may be of a turbofan or turbojet variety that produces a substantial amount of thrust to propel aircraft 22 by discharge of a working fluid through a nozzle. Gas turbine engine 30 may be used differently in other embodiments. For example, gas turbine engine 30 may serve as a prime mover for an electric power generator, provide mechanical power for a gas or oil pumping set, and/or operate as a marine propulsion source.

Power/propulsion system 24 also includes blade tip clearance control system 39 for gas turbine engine 30. Control system 39 includes controller 40 that has memory 42.

Controller 40 may be comprised of one or more components configured as a single unit. Alternatively, when of a multi-component form, controller 40 may have one or more components remotely located relative to the others, or otherwise have its components distributed throughout system 20. Controller 40 may be programmable, a state logic machine or other type of dedicated hardware, or a hybrid combination of programmable and dedicated hardware. One or more components of controller 40 may be of the electronic variety defining digital circuitry, analog circuitry, or both. As an addition or alternative to electronic circuitry, controller 40 may include one or more mechanical, hydraulic, pneumatic, or optical control elements.

In one embodiment including electronic circuitry, controller 40 has an integrated, semiconductor processing unit operatively coupled to one or more solid-state, semiconductor memory devices defining, at least in part, memory 42. For this embodiment, at least a portion of memory 42 contains programming to be executed by the processing unit and is arranged for reading and writing of data in accordance with one or more routines executed by controller 40.

Memory 42 may include one or more types of solid-state electronic memory, magnetic memory or optical memory. For example, memory 42 may include solid-state electronic Random Access Memory (RAM), Sequentially Accessible Memory (SAM) (such as the First-In, First-Out (FIFO) variety or the Last-In First-Out (LIFO) variety), Programmable Read Only Memory (PROM), Electrically Programmable Read Only Memory (EPROM), or Electrically Erasable Programmable Read Only Memory (EEPROM); an optical disc memory (such as a DVD or CD ROM); a magnetically encoded hard disc, floppy disc, tape, or cartridge media; or a combination of any of these memory types. Also, memory 42 may be volatile, nonvolatile, or a hybrid combination of volatile and nonvolatile varieties.

Besides memory 42, controller 40 may also include any oscillators, control clocks, interfaces, signal conditioners, filters, limiters, Analog-to-Digital (A/D) converters, Digital-to-Analog (D/A) converters, communication ports, or other types of operators as would occur to those skilled in the art to implement the present invention.

Controller 40 may be arranged to provide a number of routines to regulate various aspects of the operation of gas turbine engine 30 and/or aircraft 22. Alternatively, controller 40 may be dedicated to control of only one operational aspect of system 20, such as blade tip clearance. Controller 40 is operatively coupled to sensors 46 to detect corresponding information about the performance of gas turbine engine 30 in general and compressor 32 specifically. Sensors 46 may provide a signal in either a digital or analog format compatible with associated equipment. Correspondingly, equipment coupled to each sensor, such as controller 40, is configured to condition and convert sensor signals to the appropriate format, as required.

As shown in FIG. 1, controller 40 is also operatively coupled to electromagnetic actuator 50 via electrical power source 60 to direct operation thereof, and operator input device 70. The operation of controller 40 with respect to such elements will be more fully described hereinafter; however, further aspects of compressor 32 are first described as follows.

Figure 2:
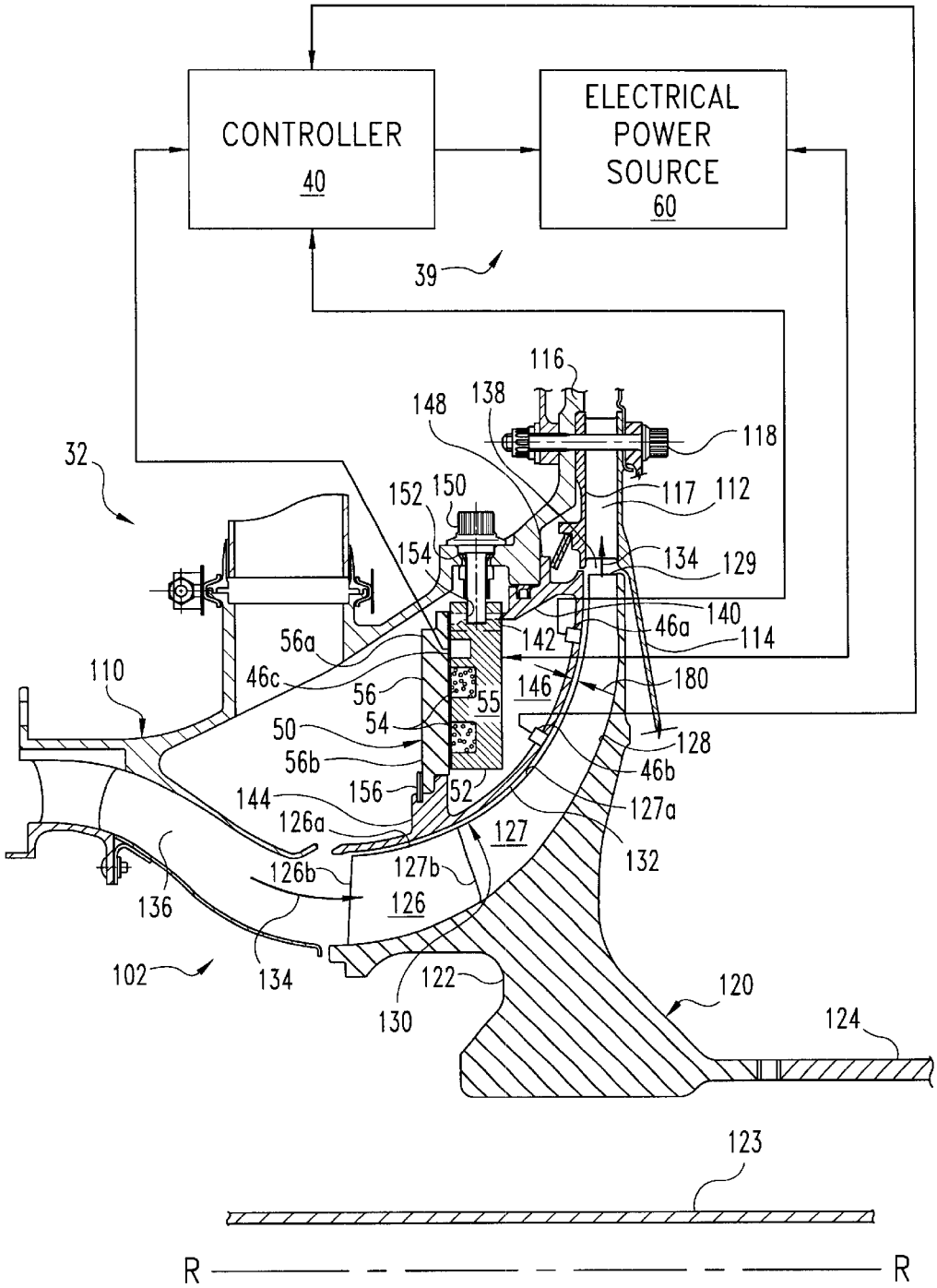
FIG. 2 is a partial diagrammatic, sectional view of the system shown in FIG. 1.
Figure 3:
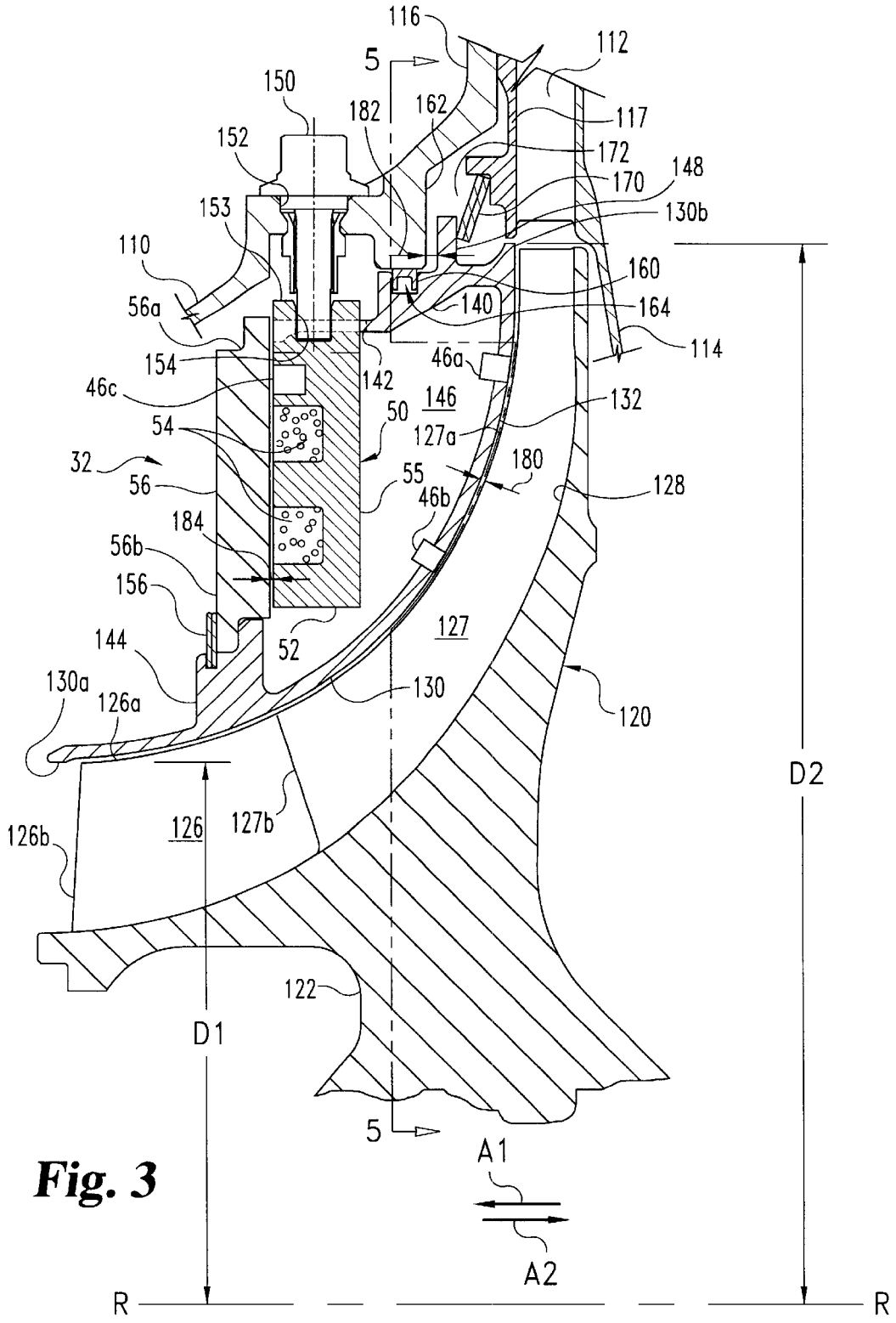
FIGS. 3 and 4 are enlarged sectional views of a portion of the compressor stage shown in FIG. 2 to illustrate different operating positions.
Figure 4:
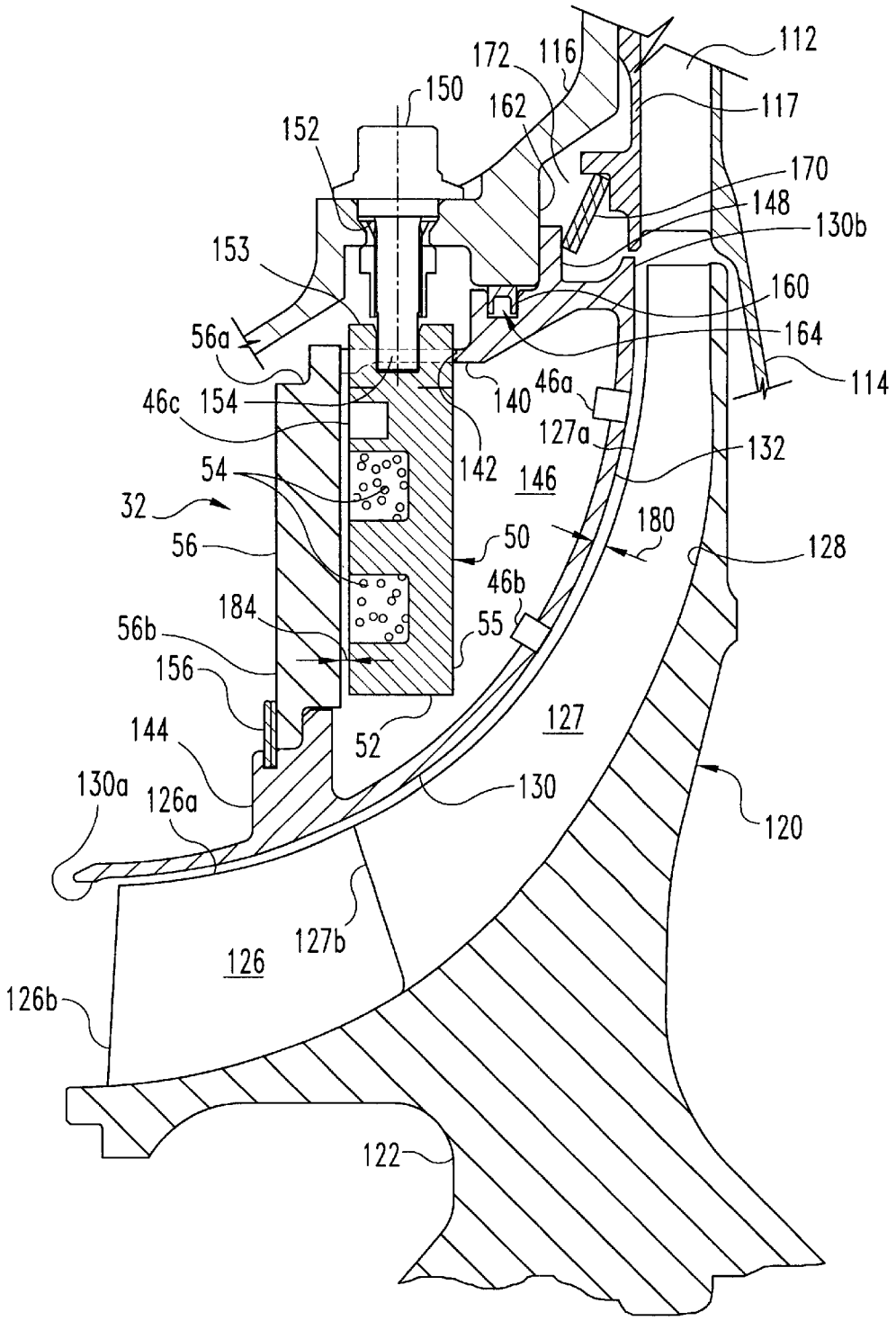

Referring additionally to FIGS. 2–5, compressor 32 includes centrifugal compressor stage 102 that is illustrated in partial cross-section. It should be appreciated that in order to preserve clarity, features of only an upper portion of compressor 32 are shown in section in FIGS. 2–4. The lower portion of compressor 32 (not shown) is generally a mirror image about axis R—R with respect to the features of compressor 32 that are shown in FIGS. 2–4.

Compressor 32 includes forward casing 110 and aft casing 114. Aft casing 114 includes compressor exit guide vanes 112 (only one of which is shown to preserve clarity), and support plate 117. The aft portion of casing 110 forms outer wall 116. Casings 110, 114 are shown coupled together by bolt 118 in FIG. 2. Casings 110, 114 generally extend about axis R—R in an annular manner. Further, while only one bolt 118 is shown, a number of bolts 118 are spaced apart from one another about axis R—R at generally regular angular intervals with respect to axis R—R to secure casings 110, 114 together. However, in other embodiments, a different coupling method, casing arrangement, or both may be utilized.

Within casing 110, a rotor or impeller 120 is illustrated having rotor hub or disc portion 122 coupled to cylindrical compressor shaft portion 124. For the illustrated embodiment, compressor shaft portion 124 is configured as a hollow cylinder through which a power shaft portion 123 extends. Like compressor shaft portion 124, power shaft portion 123 can also be of a hollow, cylindrical configuration, but has a smaller outer diameter than compressor shaft portion 124. Shaft portions 123, 124 generally extend along axis R—R and are generally concentrically arranged with respect to axis R—R. Additional structural members, such as a gas generator rotor tiebolt, may extend between power shaft portion 123 and compressor shaft portion 124 along axis R—R. Impeller 120 rotates with shaft portion 124 about axis R—R during operation of compressor 32, further defining axis R—R as an axis of rotation or rotational axis for impeller 120 and shaft portion 124. Likewise the rotational axis of power shaft portion 123 is axis R—R. Either shaft portion 123 or 124 may be a part of shaft 34 shown in FIG. 1, or part of a different shaft, depending on the desired arrangement of gas turbine engine 30. In one typical turboshaft arrangement, compressor shaft portion 124 is driven by one or more first turbine stages and power shaft portion 123 is part of shaft 34 that is driven by one or more second turbine stages that rotate independent of the first turbine stages powering shaft 124.

Gas turbine engine 30 may include additional compressor stages (not shown). In one embodiment, one or more axial compressor stages are provided upstream of centrifugal compressor stage 102. In another embodiment of gas turbine engine 30, only a single compressor stage is provided that may be of a centrifugal type, axial type, or other type as would occur to those skilled in the art.

Impeller 120 includes radially extending impeller blades 126 and 127. In FIGS. 2–4, blade 126 follows a path from left to right that starts generally parallel to axis R—R at the leftmost edge **126*b* of blade 126 and then turns to an orientation generally perpendicular to axis R—R. Blade 127 is in the form of a splitter blade that starts with a leftmost edge 127*b* offset to the right of edge 126*b* of blade 126 in FIGS. 2–4. Correspondingly, blade 127 overlaps blade 126 in FIGS. 2–4, obscuring a right-hand portion of blade 126 and having a shorter running length than blade 126. Both blades 126, 127 terminate at the outer diameter margin 129 of impeller 120**.

It should be appreciated that impeller 120 includes a number of pairs of blades 126, 127 radially extending from rotor disc portion 122 with respect to axis R—R at generally regular angular intervals in an arrangement commonly associated with centrifugal compressors. The radial arrangement of blades 126, 127 of impeller 120 is further illustrated in connection with FIG. 5 to be more fully described further hereinafter. Impeller 120 includes inner wall 128 adjacent blades 126, 127. Opposite inner wall 128, blade tip shroud 130 defines outer wall 132. Outer wall 132 is adjacent to blade tips 126*a,* 127*a* of blades 126, 127, respectively, defining blade tip clearance gap 180 therebetween.

Inner wall 128 and outer wall 132 cooperate to define fluid flow path 134 designated by arrows in FIG. 2. A different fluid flow path 134 is defined for each blade 126, 127 and moves in relation to the rotation of impeller 120 about axis R—R. Compressor 32 includes a generally annular, axial inlet 136 to deliver a fluid along axis R—R to fluid flow path 134 for each blade 126, 127. Compressor 32 also includes a generally annular radial outlet 138 to radially discharge fluid from each fluid flow path 134. Inlet 136 and outlet 138 are generally centered with respect to axis R—R. During operation of gas turbine engine 30, impeller 120 of stage 102 rotates to pressurize a fluid, typically air, as it flows along fluid flow path 134 from inlet 136 to outlet 138. Accordingly, fluid pressure at outlet 138 is relatively high compared to fluid pressure at inlet 136. Each fluid flow path 134 associated with a respective blade 126, 127 of impeller 120 contributes to the fluid pressurization.

Outer wall 132 of shroud 130 extends about axis R—R and is generally annular and centered with respect to axis R—R. Shroud 130 includes a forward extension or projection 140 defining aperture 142. Aperture 142 receives a portion of electromagnetic actuator 50 therethrough. A portion of projection 140 extending behind electromagnetic actuator 50 in FIGS. 2–4 is shown in phantom. Shroud 130 also includes radially extending pilot 144 and radial flange 148 extending from projection 140. Collectively, outer wall 132, projection 140, and pilot 144 define cavity 146. As specifically designated in FIG. 3, shroud 130 has inner margin 130*a,* a radial distance D1 from axis R—R corresponding to its inner diameter, and outer margin 130*b* a radial distance D2 from axis R—R corresponding to its outer diameter. Electromagnetic actuator 50 is at least partially positioned in cavity 146 between margins 130*a* and 130*b*.

Electromagnetic actuator 50 includes annular stator 52 with electrical coil 54 to collectively define electromagnet 55. Electromagnet 55 is operatively coupled to electric power source 60 which is controlled by controller 40. Radial pin 150 extends through opening 152 defined by forward casing 110 to engage hole 154 defined along the outer diameter of stator 52. Correspondingly, radial pin 150 fixes stator 52 to forward casing 110. Lug 153 projects along the outer diameter of stator 52 to engage aperture 142. This projecting lug 153 assists in maintaining stator 52 in position within cavity 146 in cooperation with aperture 142 of projection 140. A number of apertures 142, radial pins 150, openings 152, lugs 153, and holes 154 are radially positioned at regular angular intervals about axis R—R to securely fix annular stator 52 relative to forward casing 110 in a desired position within cavity 146.

Electromagnetic actuator 50 also includes actuating member 56 in the form of a generally annular actuating plate. Actuating member 56 is comprised of a magnetically attractable material and positioned generally opposite stator 52. Electromagnetic actuator 50 is arranged to selectively generate a magnetic field between stator 52 and actuating member 56. This field provides a corresponding force to control relative spacing between stator 52 and actuating member 56. Actuating member 56 has end portion 56*b* corresponding to its inner diameter opposite end portion 56*a* corresponding to its outer diameter. Actuating member 56 is sized and shaped to radially extend from pilot 144 to projection 140 between inner margin 130*a* and outer margin 130*b* with end portion 56*b* engaging pilot 144 and end portion 56*a* engaging projection 140. Snap ring 156 is utilized to retain end portion 56*b* in cooperation with pilot 144 to correspondingly fix actuating member 56 to shroud 130 to travel therewith. End portion 56*a* of actuating member 56 abuts and is axially preloaded against projection 140.

In cooperation with the connection of lugs 153 to casing 110 by pins 150, the boundary of apertures 142 can be engaged with lugs 153 in a bearing relationship as they extend therethrough. Correspondingly, rotation of shroud 130 about axis R—R relative to stator 52 in response to a magnetic field generated between stator 52 and actuating member 56 is reduced or prevented. It should be understood; however, that lugs 153 and apertures 142 are typically sized to permit a range of travel of shroud 130 along axis R—R relative to lugs 153 and casing 110. Alternatively or additionally, casing 110 may include one or more lugs or other structures that extend through one or more apertures 142 of shroud 130 to limit/prevent shroud rotation relative to stator 52 through formation of a bearing relationship.

Figure 5:
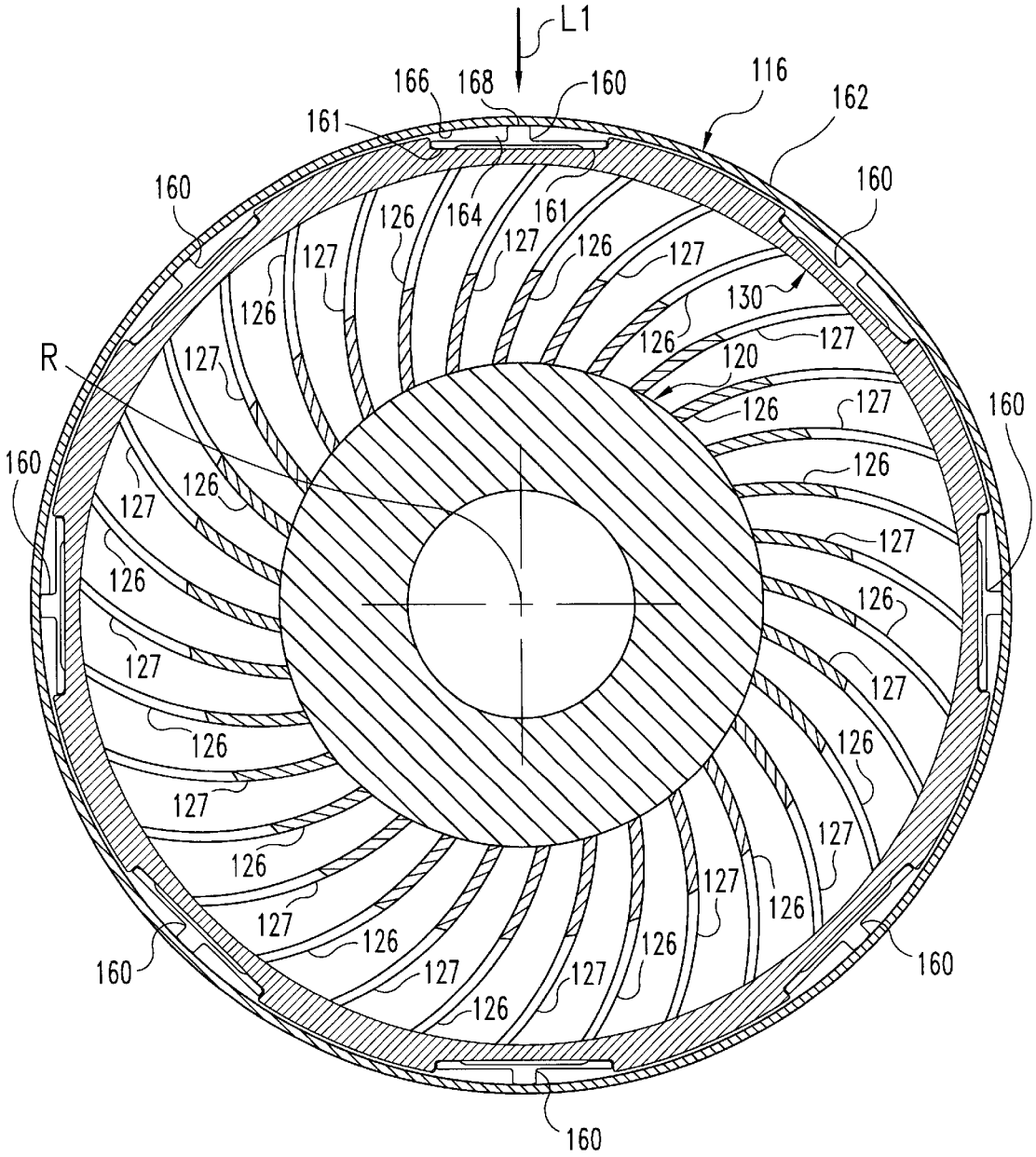
FIG. 5 is a partial, sectional view taken along section line 5—5 shown in FIG. 3.

Referring more specifically to FIGS. 3–5, further details concerning the orientation of shroud 130 relative to casing 110 and impeller 120 are described. FIG. 5 is a partial sectional end view taken along section line 5—5 of FIG. 3 and further provides a view of both the upper and lower portions of compressor 32 about axis R—R, but does not show power shaft portion 123. Axis R—R is generally perpendicular to the view plane of FIG. 5 and corresponds to the crosshair designated by R in FIG. 5.

A number of radially positioned springs 160 are disposed about axis R—R in corresponding pockets 164 defined by shroud 130. Pockets 164 are adjacent annular leg 162. In FIG. 5, features of only the topmost spring 160 are fully designated by reference numerals to preserve clarity, it being understood that the remaining springs 160 have like features as shown in the illustration. Each spring 160 includes a crowned outer engagement surface 168 defined by a radius that is the same or smaller than a radius defining inner diffuser surface 166 of leg 162. Each spring 160 also includes two contact feet 161 to engage shroud 130 in the bottom of the respective pocket 164. A mechanical load is imposed on each spring 160 by leg 162 in an inward radial direction with respect to axis R—R through contact established between surface 166 and surface 168. This radial load is represented by arrow L1 for the topmost spring 160 shown in FIG. 5. Each spring 160 correspondingly elastically deforms in response to this radial load to exert pressure on shroud 130 via contact feet 161. In this manner, springs 160 yieldingly coact to generally center shroud 130 about axis R—R, while still permitting a range of motion of shroud 130 relative to axis R—R and impeller 120 in response to other forces. Typically, springs 160 and/or leg 162 are coated (not shown) to reduce wear at the contact between surface 166 and surface 168. Alternatively or additionally, lubrication may be utilized (not shown). In still other embodiments, such treatments may not be desirable.

In FIG. 5, a partial sectional view of impeller 120 is also provided including the depiction of a portion of each of blades 126, 127 about axis R—R. As most clearly shown in FIG. 5, it should be appreciated that as blades 126, 127 each extend away from axis R—R, each blade 126, 127 also has a degree of curvature about axis R—R. Notably, while FIG. 5 depicts eight (8) centering springs 160 and corresponding pockets 164, and sixteen (16) pairs of blades 126, 127; more or fewer blades and/or centering springs 160 with corresponding pockets 164 may be utilized in alternative embodiments. In another embodiment, one or more undulating or wave-type springs may be utilized in addition or as an alternative to one or more of springs 160. Examples of this type of spring are described in U.S. Pat. No. 5,749,700 to Henry et al, and U.S. Pat. No. 5,104,287 to Ciokajlo, which are hereby incorporated by reference. Indeed, in still other embodiments, springs 160 and corresponding shroud pockets 164 may not be desired, instead using other types of biasing members and/or techniques to maintain a desired spatial relationship with various surroundings of the gas turbine engine.

Outer wall 116, support plate 117, and shroud 130 cooperate to define recess 172. Recess 172 houses a generally annular shaped biasing member 170. Biasing member 170 is arranged to mechanically impart a biasing force on shroud 130 to cause shroud 130 to travel to the left along arrow A1 generally parallel to axis R—R when unopposed by a counteracting force (see FIG. 3). However, travel along arrow A1 under the influence of biasing member 130 is limited by contact between flange 148 and leg 162. Biasing member can be in the form of one or more annular belleville washers, and can additionally or alternatively include one or more helical springs, leaf springs, or such other biasing structure or structures as would occur to those skilled in the art. The arrangement of biasing member 170 in recess 172 further provides a seal to prevent leakage of high pressure fluid in the vicinity of outlet 138 into the lower pressure regions of casing 110 and cavity 146.

Referring generally to FIGS. 1–5, selected operational aspects of system 20 are next described. As previously set forth, impeller 120 rotates to compress and pressurize a fluid, such as air, received from inlet 136 for discharge at a relatively higher pressure through outlet 138. The pressurized fluid discharged from outlet 138 may be provided to a diffuser or may otherwise be utilized as would occur to those skilled in the art. Typically, to improve pressurization efficiency, it is desirable for blade tips 126*a,* 127*a* to be as close to outer wall 132 of shroud 130 as possible during rotation of impeller 120, while at the same time not touching or rubbing shroud 130. Moreover, as operating conditions of gas turbine engine 130 change, the spacing of blade tips 126*a,* 127*a* relative to shroud 130 may vary. For example, changes in temperature may result in different spacing due to different temperature coefficients of expansions of various materials comprising gas turbine engine 130. As a result, it is sometimes desirable to actively and dynamically control blade tip clearance by adjusting gap 180 during engine operation.

Control system 39 provides a means to actively and dynamically control blade tip clearance by selectively modulating electric power supplied to electromagnetic actuator 50. More specifically, electromagnet 55 of electromagnetic actuator 50 responds to electrical current flow through coil 54 to generate a magnetic field in gap 184 between stator 52 and actuating member 56. When this magnetic field is of sufficient strength, it attracts actuating member 56 towards stator 52, causing actuating member 56 to move along axis R—R in opposition to the bias presented by biasing member 170. Because actuating member 56 is fixed to shroud 130, shroud 130 moves with actuating member 56 relative to axis R—R and impeller 120 to the right along arrow A2 in response to this magnetic attraction (see FIG. 3). Correspondingly, gap 180 between blades 126, 127 and shroud 130 decreases, while gap 182 between flange 148 and leg 162 increases. By modulating the amount of electrical current flowing through coil 54 with controller 40 via source 60, and correspondingly the amount of electrical power delivered to electromagnetic actuator 50, the strength of the magnetic field generated by electromagnet 55 may be selectively varied to adjust the position of shroud 130 relative to impeller 120 along axis R—R. Thus, electromagnetic actuator 50 provides for the adjustment of clearance between blades 126, 127 of impeller 120 and shroud 130 over a given range of distance limited at one extreme by contact between flange 148 and leg 162, and at the other extreme by contact between blade 126 or blade 127 and outer wall 132 of shroud 130 and/or the amount of bias provided by biasing member 170. However, contact between blades 126, 127 and shroud 130 is typically not desired.

Instead, referring specifically to FIG. 3, one example of a desired minimum extreme of the clearance range between shroud 130 and impeller 120 is illustrated. For this arrangement, gap 184 between stator 52 and actuating member 56 may be reduced to a very small minimum value. In contrast, gap 182 is at a maximum corresponding to maximum opposition to biasing member 170. Likewise, for this position, electrical current supplied by source 60 through coil 54, and the corresponding amount of electrical energy or power provided to electromagnetic actuator 50 is at a high level. In one embodiment, shroud 130, impeller 120, stator 52, and actuating member 56 are arranged and sized to provide a shroud/impeller gap 180 of about 0.002 inch, a flange/leg gap 182 of about 0.025 inch, and a stator/actuating member gap 184 of about 0.005 inch for the desired minimum extreme clearance range illustrated in FIG. 3. However, it should be understood that in other embodiments different sizing and/or relative arrangements may be used. In one such alternative, gap 184 is effectively eliminated by contact between stator 52 and actuating member 56 for the minimum clearance extreme.

Referring next specifically to FIG. 4, one example of a desired maximum extreme of the clearance range between shroud 130 and impeller 120 is illustrated. It should be appreciated that this desired maximum extreme is maintained by the force imparted on shroud 130 by biasing member 170, being effectively unopposed by electromagnetic actuator 50. For the position shown in FIG. 4, gaps 180, 184 are at a maximum, and gap 182 is not appreciably present due to contact between leg 162 and flange 148. Furthermore, electrical current flow through coil 54 is relatively low or nonexistent compared to the electrical current flow through coil 54 to provide the extreme position shown in FIG. 3. Moreover, the desired maximum clearance position of FIG. 4 becomes the fail-safe position when current is not being supplied to coil 54, such as may occur during an unexpected power loss to electromagnetic actuator 50. In one embodiment of this desired maximum extreme, shroud 130, impeller 120, stator 52, and actuating member 56 are arranged and sized to provide a shroud/impeller gap 180 of about 0.020 inch and a stator/actuating member gap 184 of about 0.030, with gap 182 being effectively closed by contact between flange 148 and leg 162. It should be understood that like the desired minimum clearance extreme, in other embodiments the arrangement and sizing of various components may differ for the desired maximum clearance extreme. Indeed, in one alternative embodiment, gap 182 may not be effectively closed.

In one embodiment providing active blade tip clearance control with electromagnetic actuator 50, controller 40 includes a routine to regulate clearance by selectively determining a desired amount of clearance based on one or more parameters and generating an actuation signal in correspondence with any change needed in the electrical power or current supplied to electromagnetic actuator 50 to provide the desired amount of clearance. For the illustrated embodiment, controller 40 includes a clearance control schedule 44 in memory 42. Schedule 44 may be in the form of a look-up table, mathematical expression, or other format that provides the desired amount of clearance in accordance with one or more referenced conditions. For example, schedule 44 may include a set of clearance amounts relating to various detected modes of operation of aircraft 22 and/or gas turbine engine 30, such as;

(a) a first amount of clearance for a transient operation mode;

(b) a second amount of clearance for an increased power operation mode; and (c) a third amount of clearance for a cruise operation mode;

where the first amount of clearance is greater than the second amount of clearance, and the second amount of clearance is greater than the third amount of clearance. Input device 70 can be a throttle or other operator control that generates a corresponding input signal. Controller 40 receives the input signal from device 70 and can partially or completely determine the mode of operation from this input signal, and correspondingly determine a desired amount of clearance for this embodiment.

Alternatively or additionally, controller 40 can be arranged to provide the desired amount of clearance based on input from one or more clearance detectors belonging to sensors 46 of FIG. 1. In FIGS. 2–4, reference numerals 46*a*, 46*b*, and 46*c* specifically illustrate three sensors 46 of a clearance detector type. This type of detector is discussed, for example, in U.S. Pat. No. 5,263,816 to Weimer et al., which is hereby incorporated by reference. Detectors 46*a* and 46*b* are positioned on shroud 130 to measure clearance between the blades of impeller 120 and shroud 130. Detector 46*c* is positioned on stator 52 to measure the air gap of actuator 50 corresponding to the clearance of the impeller blades and shroud 130. Alternatively or additionally, sensors 46 may include one or more pressure, temperature, or flow rate detectors to determine an unstable operating characteristic, such as a surge or stall condition. In such a case, shroud 130 could be moved to a position that would shift the operating line of compressor 32 away from the surge or stall line. In one alternative embodiment, clearance detectors are only present on actuator 50 or shroud 130. In still other embodiments, more or fewer sensors or clearance detectors may be utilized and/or positioned in different locations than illustrated.

In another embodiment, a desired clearance amount may be provided from schedule 44 in accordance with an empirical determination made for the particular compressor in addition or as an alternative to other techniques. Such a determination may be periodically updated as the engine ages and wears. Controller 40 may include appropriate signal conditioning, limiting, and/or filtering to provide for smooth and stable regulation of blade tip clearance, with or without utilizing negative feedback control techniques. Indeed, in one alternative embodiment, a single target clearance value is constantly sought using feedback techniques in lieu of a multi-valued schedule. In yet other embodiments, active clearance control may not be desired or may merely be optional. In one such alternative, clearance is manually adjusted. In another alternative, clearance is only adjusted when gas turbine engine 30 is not operating.

Many other alternative embodiments of the present invention are also envisioned. For example, power/propulsion system 24 may be adapted to be the prime mover and/or power source for a vehicle other than an aircraft, such as a marine vehicle or land vehicle, utilizing the same blade tip clearance control system 39. In another example, gas turbine engine 30 and blade tip clearance control system 39 may be incorporated into a stationary application such as a pumping set for gas or oil transmission lines, electricity generation, or another industrial gas turbine engine application type.

In further embodiments, blade tip clearance control system 39 may be applied to other compressor arrangements. In one such example, blade tip clearance for one or more stages of an axial compressor are regulated with control system 39 for a turbomachine that may or may not include a centrifugal compressor stage. In another example, control system 39 is utilized for both centrifugal and axial compressor stages of the same turbomachine. In yet another example, control system 39 regulates blade clearance of a fan stage of a turbofan either with or without regulating blade tip clearance of any other compressor stages that may be present.

In still other embodiments, blade tip clearance control system 39 is utilized to control clearance of a rotor used in a different part of a gas turbine engine, such as a turbine stage, or with a different type of turbomachine altogether, such as a steam turbine or turbopump. U.S. Pat. No. 5,203,673 to Evans provides one nonlimiting example of such an alternative type of turbomachine to which control system 39 could be applied, and is hereby incorporated by reference.

In a further embodiment, the actuator geometry is not annular, but instead the actuating member 56, stator 52, or both are differently shaped. For instance, stator 52 and/or actuating member 56 may be provided in the form of one or more sectors or bars radially or circumferentially oriented about axis R—R. In yet another embodiment, electromagnetic actuator 50 is oriented to provide for radial displacement of shroud 30 in addition or as an alternative to translational displacement relative to the rotational axis for impeller 120. Furthermore, the electromagnetic actuation techniques of the present invention may be combined with other actuation techniques to control blade clearance, including but not limited to pneumatic actuation, hydraulic actuation, and/or actuation based on one or more temperature responsive materials.

In still a further embodiment of the present invention, a gas turbine engine includes a shroud and a rotor. The rotor includes a number of blades and is disposed within the shroud. The rotor rotates about an axis to pressurize a fluid during operation of the engine. Also included is a first sensor operable to monitor for engine instability due to, for example, surge or stall. A controller responds to the first sensor to determine a desired amount of axial spacing between the shroud and the blades to maintain operating stability of the engine and provide a control signal in correspondence with the desired amount spacing. An electromagnetic actuator responds to this control signal to adjust position between the shroud and the blades of the rotor along the axis.

For other embodiments, one or more members of electromagnetic actuator 50 may be integral to shroud 130. Indeed, shroud 130 may be formed in whole or in part of a material responsive to electromagnet 55 and be shaped so that actuator 50 need not include a separate actuating member 56. In addition to the movement of shroud 130 relative to impeller 120, for further alternative embodiments, rotors/impellers and corresponding shafts may additionally be axially and/or radially adjustable relative to shroud 130. Commonly owned U.S. Pat. No. 5,658,125 to Burns et al. describes techniques to move rotors/impellers and shafts and is hereby incorporated by reference.

All publications, patents, and patent applications cited in this specification are herein incorporated by reference as if each individual publication, patent, or patent application were specifically and individually indicated to be incorporated by reference and set forth in its entirety herein. Further, it is not intended that the present invention be limited or restricted to any expressed theory or mechanism of operation provided herein. While the invention has been illustrated and described in detail in the drawings and foregoing description, the same is to be considered as illustrative and not restrictive in character, it being understood that only the preferred embodiments have been shown and described and that all changes, modifications and equivalents that come within the spirit of the invention as defined by the following claims are desired to be protected.

What is claimed is:

1. A method, comprising:

providing a gas turbine engine including a shroud and an impeller;

rotating the impeller within the shroud to provide a pressurized fluid to operate the engine; and moving the shroud relative to the impeller by electromagnetic actuation to adjust clearance between the shroud and the impeller.

2. The method of claim 1, wherein said moving includes varying the clearance between the shroud and the impeller over a range in correspondence with an amount of electrical power provided to an electromagnet, the range having a minimum extreme and a maximum extreme with the clearance being at the maximum extreme when power to the electromagnet is lost.

3. The method of claim 1, wherein the shroud includes an actuation member comprised of a magnetically attractable material.

4. The method of claim 1, wherein said rotating includes turning the impeller about a rotational axis extending along the engine, the shroud being generally positioned about the rotational axis, and said moving includes translating the shroud along the rotational axis.

5. The method of claim 1, wherein the shroud includes a first actuation member and the gas turbine engine further includes a casing support with a second actuation member, and said moving includes moving the first actuation member and the second actuation member closer together by generating a magnetic field therebetween.

6. The method of claim 5, wherein the gas turbine engine includes a centrifugal compressor stage comprised of the shroud and the impeller, the first actuation member is generally annular and composed of a magnetically attractable material, the second actuation member includes an electromagnet positioned opposite the first actuation member, said moving includes varying the clearance between the shroud and the impeller over a range in correspondence with an amount of electrical power supplied to perform the electromagnetic actuation, the range having a minimum extreme and a maximum extreme with the clearance being at the maximum extreme when the electrical power is removed, and further comprising:

sensing the clearance during said rotating with a sensor coupled to the shroud;

providing a controller including a clearance schedule defining a first amount of the clearance for a transient mode of operation, a second amount of the clearance for an increased power mode of operation, and a third amount of the clearance for a cruise mode of operation, the first amount of the clearance being greater than the second amount of the clearance and the second amount of the clearance being greater than the third amount of the clearance;

regulating the clearance with the controller in accordance with the schedule and said sensing; and propelling an aircraft with the gas turbine engine.

7. A system, comprising:

a gas turbine engine including a shroud and a rotor with one or more blades, said rotor being rotatable within said shroud to pressurize a fluid during operation of said engine;

an electromagnetic actuator operable to move said shroud relative to said rotor to adjust clearance between said shroud and said one or more blades;

a controller operable to determine a desired amount of clearance in accordance with an operating mode of said gas turbine engine and generate an actuation signal to change the clearance in correspondence with the desired amount; and wherein said electromagnetic actuator responds to said actuation signal to provide the desired amount of clearance.

8. The system of claim 7, further comprising a sensor operable to provide a clearance signal representative of the clearance between said shroud and said impeller, said controller being responsive to said clearance signal to selectively generate said actuation signal.

9. The system of claim 7, wherein said controller determines said desired amount of clearance from a clearance control schedule, said schedule defining a first amount of the clearance for a transient mode of operation, a second amount of the clearance for an increased power mode of operation, and a third amount of the clearance for a cruise mode of operation, the first amount of the clearance being greater than the second amount of the clearance and the second amount of the clearance being greater than the third amount of the clearance, said controller generating said actuation signal in accordance with said schedule.

10. The system of claim 7, wherein said shroud is positioned about an axis of rotation of said rotor, said shroud has a first margin positioned a first distance from said axis and a second margin positioned a second distance from said axis, said second distance being greater than said first distance, and said electromagnetic actuator includes a first member at least partially positioned in a cavity defined by said shroud between said first margin and said second margin.

11. The system of claim 10, wherein said first member is an electromagnet and said actuator includes a second member comprised of a magnetically attractable material, said first member and said second member being movable relative to one another in response to generation of a magnetic field therebetween.

12. The system of claim 11, wherein said shroud is generally annular and generally centered about said axis, said first margin corresponds to a first radius relative to said axis and said second margin corresponds to a second radius relative to said axis, and said second member is generally annular and extends between said first radius and said second radius relative to said axis.

13. The system of claim 7, wherein said gas turbine engine includes a centrifugal compressor comprised of said shroud and said rotor, said shroud being generally centered about an axis of rotation for said rotor, and said electromagnetic actuator is operable to selectively translate said shroud along said axis.

14. The system of claim 7, further comprising an aircraft operable to be propelled by said gas turbine engine and carry said electromagnetic actuator and said controller therewith.

15. A system, comprising:

a gas turbine engine including a shroud and a rotor with one or more blades, said rotor being rotatable within said shroud to pressurize a fluid during operation of said engine;

an electromagnetic actuator operable to move said shroud relative to said rotor to adjust clearance between said shroud and said one or more blades, said electromagnetic actuator providing a range of the clearance in accordance with a level of electrical power supplied to said electromagnetic actuator;

a controller operable to determine a desired amount of the clearance and regulate the level of electrical power supplied to said electromagnetic actuator in correspondence with the desired amount of the clearance; and at least one biasing member to provide a maximum extreme of said range when no electrical power is supplied to said electromagnetic actuator.

16. The system of claim 15, wherein said gas turbine engine includes a casing support member and said at least one biasing member is positioned between said casing support member and said shroud to bias said shroud away from said one or more blades to said maximum extreme, said electromagnetic actuator being operable to oppose said biasing member when the electrical power is applied thereto.

17. The system of claim 15, wherein said gas turbine includes a casing support, said electromagnetic actuator having a first member arranged to travel with said casing support and a second member arranged to travel with said shroud.

18. The system of claim 15, wherein said controller includes means for scheduling the desired amount of clearance.

19. The system of claim 15, further comprising means for sensing the clearance, said controller being responsive to said means.

20. The system of claim 15, further comprising means for monitoring at least one of surge and stall during operation of said gas turbine engine, said controller being responsive to said means.

21. The system of claim 15, wherein said gas turbine engine includes a casing, and said electromagnetic actuator includes an electromagnet coupled to said casing, a member made of a magnetically attractable material coupled to said shroud, said electromagnet is positioned opposite said member and is operable to attract said member in accordance with the level of electrical power supplied to said electromagnetic actuator and correspondingly reduce the clearance between said shroud and said rotor.

22. A method, comprising:

operating a gas turbine engine including a shroud and an impeller, and an electromagnetic actuator to adjust clearance between the shroud and the impeller;

reducing the clearance between the shroud and the impeller during said operating by increasing electrical power supplied to the actuator; and increasing the clearance between the shroud and the impeller during said operating in response to reducing the electrical power supplied to the actuator.

23. The method of claim 22, further comprising:

providing a clearance control schedule defining a first amount of the clearance for a transient mode of operation, a second amount of the clearance for an increased power mode of operation, and a third amount of the clearance for a cruise mode of operation, the first amount of the clearance being greater than the second amount of the clearance and the second amount of the clearance being greater than the third amount of the clearance; and controlling the clearance in accordance with the schedule.

24. The method of claim 22, further comprising propelling an aircraft with the gas turbine engine.

25. The method of claim 22, wherein the electromagnetic actuator includes a first member and a second member, and said reducing the clearance includes generating a magnetic field between the first member and second member to decrease distance separating the first member and second member and correspondingly reduce the clearance.

26. The method of claim 22, further comprising varying the clearance between the shroud and the impeller over a clearance range in correspondence with an amount of the electrical power supplied to the actuator.

27. The method of claim 26, wherein the clearance goes to a maximum extreme of the clearance range in response to an electrical power loss for the actuator.

28. An apparatus, comprising: a gas turbine engine, said gas turbine engine including:

a shroud and an impeller rotatable within said shroud; and an electromagnetic actuator operable to move said shroud relative to said impeller to adjust clearance between said shroud and said impeller.

29. The apparatus of claim 28, further comprising a casing, said electromagnetic actuator having a first member arranged to travel with said casing and a second member arranged to travel with said shroud.

30. The apparatus of claim 28, wherein said electromagnetic actuator provides a clearance range that varies in correspondence with a level of electrical power supplied to said actuator, said clearance range having a minimum extreme corresponding to a supply of the electrical power at a high level and a maximum extreme provided when the electrical power is not supplied to said electromagnetic actuator.

31. The apparatus of claim 30, further comprising one or more biasing members to position said shroud a maximum distance from said impeller corresponding to said maximum extreme when a power loss to said electromagnetic actuator occurs.

32. The apparatus of claim 28, further comprising means for controlling the clearance.

33. The apparatus of claim 28, wherein said gas turbine engine includes a casing, said electromagnetic actuator includes an electromagnet coupled to said casing and a member made of a magnetically attractable material coupled to said shroud, and said electromagnet is operable to reduce distance separating said electromagnet from said member and correspondingly reduce the clearance between said shroud and said impeller.

34. The apparatus of claim 28, wherein said gas turbine engine includes a centrifugal compressor having said shroud and said impeller, said shroud is generally centered about an axis of rotation for said impeller, and said electromagnetic actuator is operable to translate said shroud along said axis.

35. The apparatus of claim 34, wherein said shroud has a first margin positioned a first distance from said axis and a second margin positioned a second distance from said axis, said second distance being greater than said first distance, and said electromagnetic actuator includes a first member at least partially positioned in a cavity defined by said shroud between said first margin and said second margin.

36. The apparatus of claim 35, wherein said first member is an electromagnet and said actuator includes a second member comprised of a magnetically attractable material, said first member and said second member being movable relative to one another in response to generation of a magnetic field therebetween.

37. The apparatus of claim 36, wherein said shroud is generally annular and generally centered about said axis, said first margin corresponds to a first radius relative to said axis and said second margin corresponds to a second radius relative to said axis, and said second member is generally annular and extends between said first radius and said second radius relative to said axis.

38. The apparatus of claim 37, further comprising:

a first sensor to provide a clearance signal corresponding to the clearance;

a second sensor to provide a monitoring signal corresponding to at least one of surge and stall;

a controller selectively responsive to said clearance signal and said monitoring signal, said controller including a clearance control schedule defining a first amount of the clearance for a transient mode of operation, a second amount of the clearance for an increased power mode of operation, and a third amount of the clearance for a cruise mode of operation, the first amount of the clearance being greater than the second amount of the clearance and the second amount of the clearance being greater than the third amount of the clearance, said controller being operable to determine a desired amount of the clearance in accordance with said clearance signal, said monitoring signal, and said clearance control schedule and generate an actuation signal in accordance with the desired amount; and wherein said electromagnetic actuator is responsive to said actuation signal to provide the desired amount of the clearance, said electromagnetic actuator provides a clearance range that varies in correspondence with a level of electrical power supplied to said electromagnetic actuator, said clearance range having a minimum extreme corresponding to a supply of the electrical power at a first level and a maximum extreme provided when the electrical power is supplied to said electromagnetic actuator at a second level less that said first level, said gas turbine engine includes one or more biasing members to position said shroud a maximum distance from said impeller corresponding to said maximum extreme when a power loss to said electromagnetic actuator occurs, and said gas turbine engine is coupled to an aircraft and is operable to propel said aircraft.

39. An apparatus, comprising: a gas turbine engine, said gas turbine engine including:

a casing, a shroud, and an impeller, said impeller being disposed within said shroud to rotate about an axis;

an electromagnetic actuator operable to adjust clearance between said shroud and said impeller; and one or more springs disposed between said casing and said shroud to impart a bias to yieldingly position said shroud about said axis.

40. The apparatus of claim 39, wherein said one or more springs include a first portion in contact with said casing and a second portion in contact with said shroud.

41. The apparatus of claim 39, wherein said one or more springs each engage said casing to slide along said axis as the clearance between said shroud and said impeller is adjusted.

42. The apparatus of claim 39, further comprising means for biasing said shroud a maximum distance from said impeller along said axis when a power loss to said actuator occurs.

43. The apparatus of claim 39, wherein said one or more springs number at least eight and are operable to generally center said shroud about said axis.

44. An apparatus, comprising: a gas turbine engine, said gas turbine engine including:

a casing, a shroud, and an impeller, said shroud and said impeller being disposed within said casing, said impeller being disposed within said shroud to rotate about an axis;

an electromagnetic actuator including a first member connected to said casing, said electromagnetic actuator being operable to control clearance between said shroud and said impeller by generating a magnetic field with said first member; and wherein an amount of rotational motion of said shroud in response to generation of the magnetic field is limited by a bearing relationship formed between said shroud and at least one of said first member and said casing.

45. The apparatus of claim 44, wherein said first member extends through said shroud to attach to said casing to reduce the amount of rotational motion.

46. The apparatus of claim 44, wherein said first member is connected to said casing by a number of pins extending through said shroud to reduce the amount of rotational motion.

47. The apparatus of claim 44, wherein said shroud and said first member are generally annular, said shroud includes a number of radial apertures and said first member includes a number of radial lugs each extending through a corresponding one of said apertures, at least one of said lugs being arranged to form said bearing relationship with said shroud.

48. The apparatus of claim 47, further comprising a number of radial pins each engaging a hole in a corresponding one of said lugs to connect said first member to said casing.

49. The apparatus of claim 44, further comprising one or more springs disposed between said casing and said shroud to impart a bias to yieldingly center said shroud about said axis.

50. The apparatus of claim 44, wherein said first member includes an electromagnet, said electromagnetic actuator further includes a second member connected to said shroud, said second member is comprised of a magnetically attractable material, and said electromagnetic actuator is operable to translate said shroud along said axis.

51. The apparatus of claim 44, wherein said shroud is generally annular and has a first margin positioned a first distance from said rotational axis and a second margin positioned a second distance from said rotational axis, said second distance being greater than said first distance, and said first member is at least partially positioned in a cavity defined by said shroud between said first margin and said second margin.

52. The apparatus of claim 44, further comprising:

at least one sensor to detect one or more operating conditions of said engine;

a controller including a clearance control schedule defining a first amount of the clearance for a transient mode of operation, a second amount of the clearance for an increased power mode of operation, and a third amount of the clearance for a cruise mode of operation, said controller being selectively responsive to said at least one sensor to generate an actuation signal to adjust the clearance in accordance with said clearance control schedule; and wherein said electromagnetic actuator is responsive to said actuation signal to provide a desired amount of the clearance.

53. An apparatus, comprising: a gas turbine engine, said gas turbine engine including:

a shroud and an impeller disposed within said shroud to rotate about an axis;

an electromagnetic actuator including a first member, said electromagnetic actuator being operable to adjust clearance between said shroud and said impeller; and wherein said shroud includes a first margin positioned a first distance from said axis and a second margin positioned a second distance from said axis, said second distance is greater than said first distance, and said first member is at least partially positioned in a cavity formed between said first margin and said second margin.

54. The apparatus of claim 53, further comprising a casing, said first member being fixed to said casing, and wherein said electromagnetic actuator includes a second member fixed to said shroud.

55. The apparatus of claim 53, wherein said shroud and said first member are generally annular, said shroud includes a number of radial apertures and said first member includes a number of radial lugs each extending through a corresponding one of said apertures.

56. The apparatus of claim 55, further comprising a casing and a number of radial pins each engaging a hole in a corresponding one of said lugs to connect said first member to said casing.

57. The apparatus of claim 53, wherein said first member includes an electromagnet, said electromagnetic actuator includes a second member, said second member is comprised of a magnetically attractable material, and said electromagnetic actuator is operable to translate said shroud along said axis.

58. The apparatus of claim 53, further comprising:

at least one sensor to detect one or more operating conditions of said engine;

a controller including a clearance control schedule defining a first amount of the clearance for a transient mode of operation, a second amount of the clearance for an increased power mode of operation, and a third amount of the clearance for a cruise mode of operation, said controller being selectively responsive to said at least one sensor to generate an actuation signal to adjust the clearance in accordance with said clearance control schedule; and wherein said electromagnetic actuator is responsive to said actuation signal to provide a desired amount of the clearance.

59. An apparatus, comprising: a gas turbine engine, said gas turbine engine including:

a casing, a shroud, and an impeller, said impeller being disposed within said shroud to rotate about an axis;

an electromagnetic actuator operable to adjust clearance between said shroud and said impeller by movement along said axis; and one or more biasing members disposed between said casing and said shroud to impart an inwardly directed radial force on said shroud to yieldingly locate said shroud in a generally centered position about said axis.

60. The apparatus of claim 59, wherein said one or more biasing members number at least eight and each includes a spring.

61. The apparatus of claim 59, wherein said one or more biasing members include a first portion in contact with said casing and a second portion in contact with said shroud.

62. The apparatus of claim 59, wherein said one or more biasing members each engage said casing to slide along said axis as the clearance between said shroud and said impeller is adjusted.

63. The apparatus of claim 59, wherein said shroud is generally annular and has a first margin positioned a first distance from said rotational axis and a second margin positioned a second distance from said rotational axis, said second distance being greater than said first distance, said electromagnetic actuator includes a first member and a second member spaced apart from said first member, said first member being at least partially positioned in a cavity defined by said shroud between said first margin and said second margin, said first member and said second member being movable relative to one another in response to generation of a magnetic field therebetween.

64. An apparatus, comprising: a gas turbine engine, said gas turbine engine including:

a casing, a shroud, and an impeller, said impeller being disposed within said shroud to rotate about an axis;

an actuator operable to selectively move one of said shroud and said impeller relative to another of said shroud and said impeller along said axis to adjust clearance between said shroud and said impeller; and one or more springs radially disposed about said axis between said casing and said shroud, said one or more springs being operable to provide a radial bias with respect to said axis to position said shroud thereabout.

65. The apparatus of claim 64, wherein said one or more springs each engage said casing to slide along said casing as said clearance is adjusted.

66. The apparatus of claim 64, wherein said one or more springs generally center said shroud about said axis over a range of said clearance.

67. The apparatus of claim 64, wherein said actuator includes a first member coupled to said shroud to move therewith as said clearance is adjusted and a second member coupled to said casing to move therewith as said clearance is adjusted, said actuator being operable to generate a magnetic field between said first member and said second member to decrease distance separating said first member and said second member and correspondingly reduce said clearance.

68. The apparatus of claim 67, wherein said gas turbine engine includes a centrifugal compressor including said shroud and said impeller, said actuator is operable to translate said shroud along said axis, and said second member is at least partially positioned in a cavity defined by said shroud.

* * * * *